US007611147B2

(12) United States Patent
Sheldon

(10) Patent No.: US 7,611,147 B2
(45) Date of Patent: Nov. 3, 2009

(54) MOVING TARGET PRACTICE APPARATUS

(76) Inventor: Brent Sheldon, 72 Sherbrooke west, Suite 3, Montreal, Quebec (CA) H2X 1X3

( * ) Notice: Subject to any disclaimer, the term of this patent is extended or adjusted under 35 U.S.C. 154(b) by 0 days.

(21) Appl. No.: 11/620,991

(22) Filed: Jan. 8, 2007

(65) Prior Publication Data

US 2008/0164657 A1 Jul. 10, 2008

(51) Int. Cl.
*F41J 9/02* (2006.01)

(52) U.S. Cl. ..... 273/366; 273/368

(58) Field of Classification Search ..... 273/390–392, 273/406, 382–389, 398–402, 366–370
See application file for complete search history.

(56) References Cited

U.S. PATENT DOCUMENTS 387,411 A * 8/1888 Gisel ..... 273/366
794,775 A * 7/1905 Bowerman ..... 273/382
1,435,768 A * 11/1922 Wang ..... 273/392
1,616,270 A * 2/1927 Madden ..... 273/401
1,657,931 A * 1/1928 Krantz ..... 273/389
1,851,647 A * 3/1932 Remonte ..... 273/368
2,039,552 A * 5/1936 Reynolds ..... 273/391
2,232,743 A * 2/1941 Swenson ..... 273/368
2,738,978 A * 3/1956 Henry ..... 273/383
2,957,694 A * 10/1960 Barber et al. ..... 273/388
3,066,938 A * 12/1962 Walz ..... 273/357
3,794,318 A * 2/1974 Holmes ..... 473/446
5,257,790 A * 11/1993 Meadows ..... 273/389
5,765,832 A * 6/1998 Huff ..... 273/354
6,736,400 B1 * 5/2004 Cesternino ..... 273/366

* cited by examiner

*Primary Examiner*—Mark S Graham
(74) *Attorney, Agent, or Firm*—Daphne L. Maravei; Blake, Cassels & Graydon LLP

(57) ABSTRACT

A moving target practice apparatus adapted to be used in the home or easily portable by a user, and increasing the challenge to a user by creating unpredictable and moving targets, including moving target areas disposed on the front of the apparatus comprising a series of apertures that align to create an opening at various intervals in time to receive a projectile and/or a series of moving toppling targets traveling around the apparatus which are automatically resetable to an upright position once hit by a projectile.

10 Claims, 7 Drawing Sheets

MOVING TARGET PRACTICE APPARATUS

BACKGROUND OF THE INVENTION

This invention relates to a moving target practice apparatus mainly for use with firearms, including but not limited to airguns, bb guns, pellet guns, air rifles and soft airguns. More particularly, this invention relates to a moving target practice apparatus for shooting practice that is easily transported and is capable of producing movement for increasing the challenge for shooting practice. The invention is not limited to firearms and can also be used with non-firearm projectiles, such as projectiles thrown by a user, including but not limited to darts or balls used for games.

Target apparatus for shooting practice are generally found in shooting galleries and amusement parks. In a basic target apparatus, a marksman can practice his/her hitting accuracy by shooting at a stationary target, for instance one made of a sticky gel substance that permits projectiles to either become embedded therein or stick for a few seconds then drop into a suitable catch bin (also known as a "sticky target"). For a more challenging practice, a marksman can practice his/her skill, judgment and timing by shooting at a moving target.

Target practice apparatus that can be used at home are becoming increasingly popular and desirable. However, most conventional home target practice systems are not challenging enough in that they tend to be of the basic stationary variety. Conventional moving target apparatus are large, heavy and expensive and are not adapted to be used in the home, or carried by hand and moved to different locations. Furthermore, such practice apparatus usually have targets that topple when hit, and then must be reset again manually. This is inconvenient, time consuming and interrupts the flow of target practice.

It would be advantageous to provide a portable moving target practice apparatus having an element of unpredictability for the user via a series of apertures that align to create openings which reveal a visual cue to a user to fire. It would be advantageous to simultaneously provide an apparatus comprising toppling targets that are automatically resetable from a toppled position to an upright position providing uninterrupted practice for the marksman.

It would be advantageous to be able to collect projectiles that hit the moving target practice apparatus.

It would be advantageous to provide a moving target apparatus which is simple in construction and inexpensive to manufacture and portable by a user.

SUMMARY OF THE INVENTION

The present invention relates to a moving target practice apparatus for use with air guns, bb guns, pellet guns and air rifles and more particularly, to a target apparatus that is capable of generating visual and audio effects and comprises a front panel which accommodates moving targets defined by a series of apertures on two different target areas, one disposed behind the other, which align to create an opening via the rotation of at least one of said target areas and produces toppling movement as a plurality of knock down targets which are automatically resetable to an upright position. The apparatus of the present invention therefore provides uninterrupted practice of the moving variety for a user.

The present invention also provides a means of collecting projectiles after they are fired at the moving target practice apparatus.

In accordance with an aspect of the present invention there is provided a moving target practice apparatus comprising a front casing mounted to a rear panel, wherein said front casing supports at least one outer target means; said at least one outer target means comprising at least one first aperture; at least one inner target means disposed behind said at least one outer target means between said front casing and rear panel; said inner target means comprising at least one second aperture, means for rotating at least one of said inner target means and said outer target means, such that said at least one first aperture and said at least one second aperture will align to create an opening to receive a projectile.

In accordance with a further aspect of the present invention described herein, there is provided a moving target practice apparatus comprising a front casing and a rear panel to form a generally enclosed target area, wherein said rear panel defines an exposed channel with said front casing; said channel extending between said casing and the circumference of the rear panel; said channel having a narrow portion and a wide portion, said wide portion disposed along said channel between a first and second point along said channels; at least one toppling target supported in said channel wherein said target will topple when hit, said channel defining a path for the target; means for moving said at least one toppling target around the channel; said at least one toppling target being in an upright position when in said wide portion; said at least one toppling target is pushed in a down position if not hit, when said at least one toppling target travels through said first point into said narrow portion; and wherein said at least one toppling target is forced in an upright position when it travels through said second point returning to said wide portion.

BRIEF DESCRIPTION OF THE DRAWINGS

In FIG. 6A, the toppling target is shown with a circular impact paddle;

FIG. 6B shows a cross-section view of the toppling target and pin connection;

Figure 1:
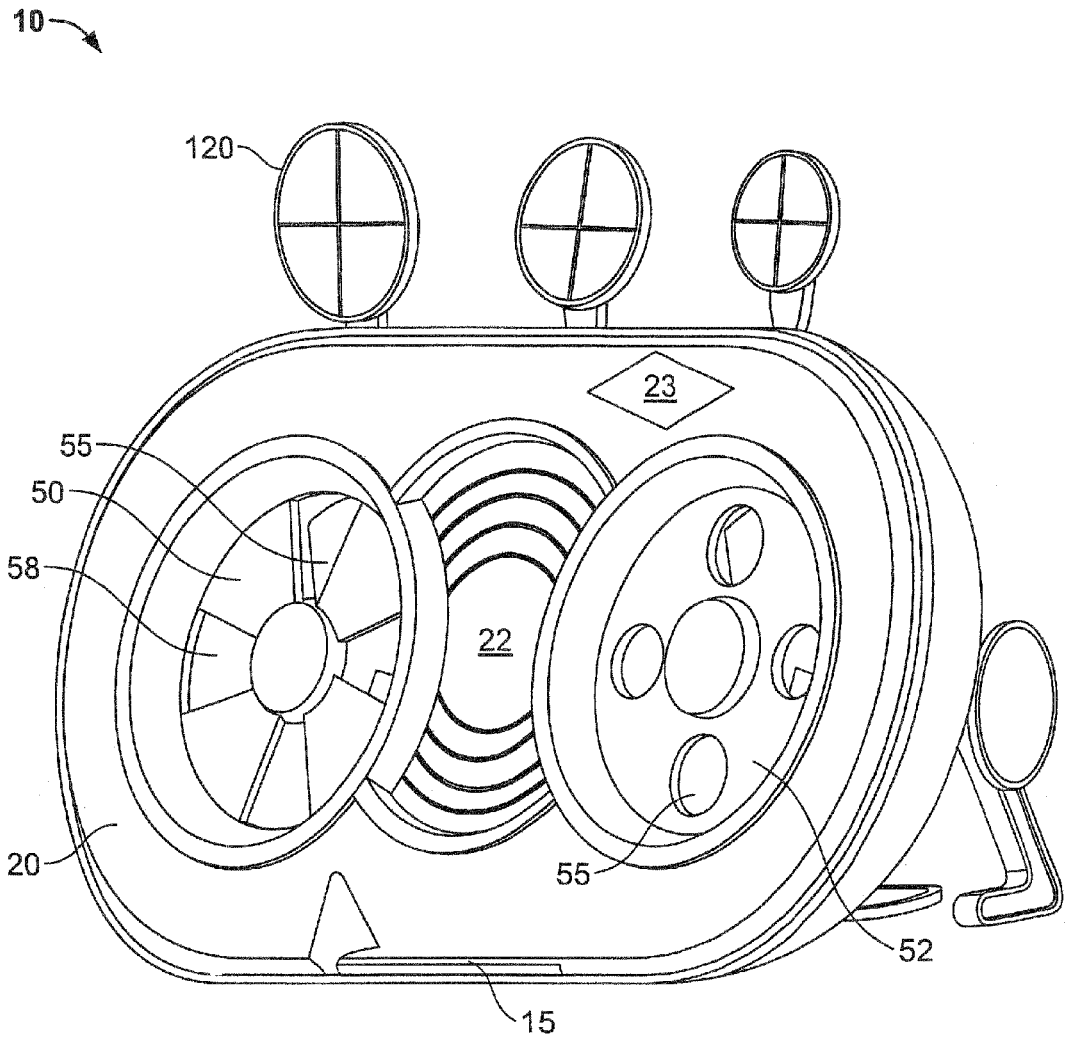
FIG. 1 is a front perspective view of the moving target apparatus.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Figure 2:
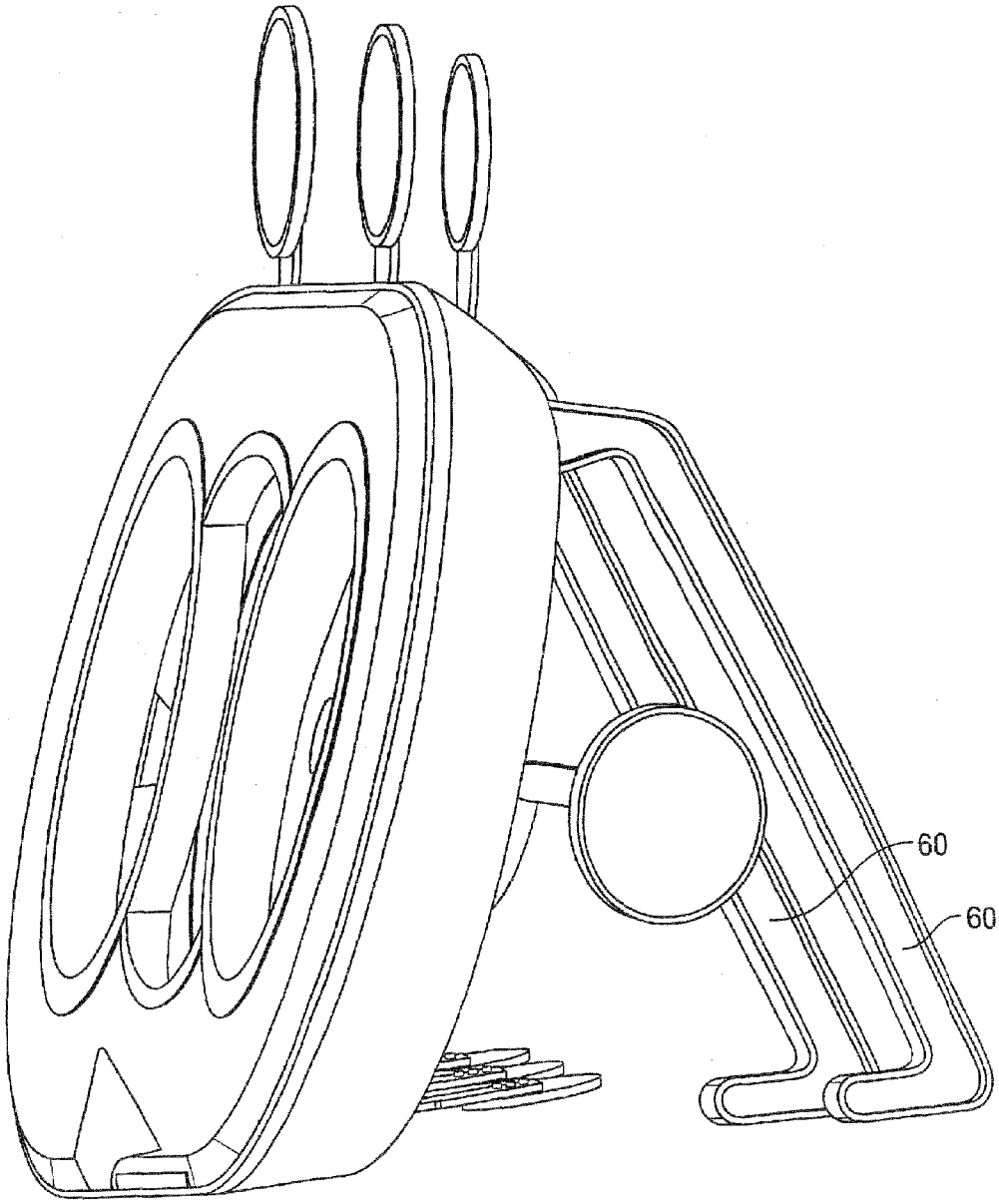
FIG. 2 is a right side view of the moving target apparatus.

Referring to FIGS. 1, 2 and 3, the moving target apparatus 10 of the present invention generally includes a front casing 20 mounted to a rear panel 40.

Front casing 20 accommodates outer target areas 50 and 52, which comprise a series of apertures 55. As described in more detail below, apertures 55 may reveal an opening 58 at various intervals in time to accept a projectile, thereby providing an unpredictable moving target for a marksman. Resetable toppling targets 120 travel around the apparatus 10 and will topple when hit by a projectile. In the embodiment shown in FIG. 1, toppling targets 120 are upright at the top of the apparatus and if not knocked down by a projectile, and will automatically be pushed down as they travel around the apparatus 10. Said targets 120 will be reset in the upright position as they return to the top of the apparatus 10.

As shown, in FIG. 1, the body of apparatus 10 is constructed in a generally rectangular shape. In an alternate embodiment of the invention, the body of apparatus 10 may be constructed in any desired polygonal shape and may have irregular curvilinear top, bottom or side portions.

The casing 20 and panel 40 are made of a sturdy plastic or a metal or any other suitable material. While the term projectile is referred to throughout, this term is intended to encompass all types of projectiles, including but not limited to bbs, pellets and bullets fired from a gun or any projectile which can be thrown by a user.

Referring to FIG. 2, the target apparatus 10 is adapted to stand on a table or horizontal surface to hold it level and be fired at from this position. In one embodiment of the invention, the apparatus may be equipped with one or more L-shaped stands 60 affixed to the rear panel of 40 of the apparatus 10. Stands 60 may be foldably attached to the rear panel 40 for instance, by way of a hinge or other well-known manner, such that they may be collapsed for ease of packing, storage and transport of apparatus 10. In a further embodiment, apparatus 10 is adapted to stand alone on its base, without a stand. Apparatus 10 may alternatively be constructed to be suspended, for instance from a hook portion disposed in the rear panel 40 or other known manner.

The front casing 20 may additionally comprise a stationary impact area or plurality of impact areas suitable as stationary targets. As seen in FIG. 1, in a preferred embodiment an impact area 22 is disposed between the two moving target areas 50 and 52 and may be covered by a sticky rubber mat having a large stretching ratio or any other suitable substance adapted to accept projectiles that are fired at such a mat. Said mat may be scored in the well-known manner or display any suitable target image or design.

In a further embodiment, the front casing 20 may be comprised of or covered by a number of different materials, including but not limited to a piece of rubber or metal, suitable as impact area 23, such that a different sound is yielded when said materials are hit by a projectile and which therefore may be scored differently when hit by a marksman/user. Impact area 23 may be located on any portion of front casing 20. Further, any number of impact areas 23 may cover the front casing 20 and may be comprised of different or identical materials.

In another embodiment, impact area 22 or 23 may accommodate other types of targets, such as bobbing or spinning objects that are resetable and activated by gravity, as is the case for instance where one side of an object is heavier than the other side and therefore automatically resets itself after being hit by a projectile. Said other types of targets may be recessed into or be adapted to extend or hang from front casing 20. In another embodiment, impact area 22 or 23 may comprise a sensor as is known in the art, such that said sensor will emit a sound or other audiovisual cue when hit by a pellet.

Figure 3A:
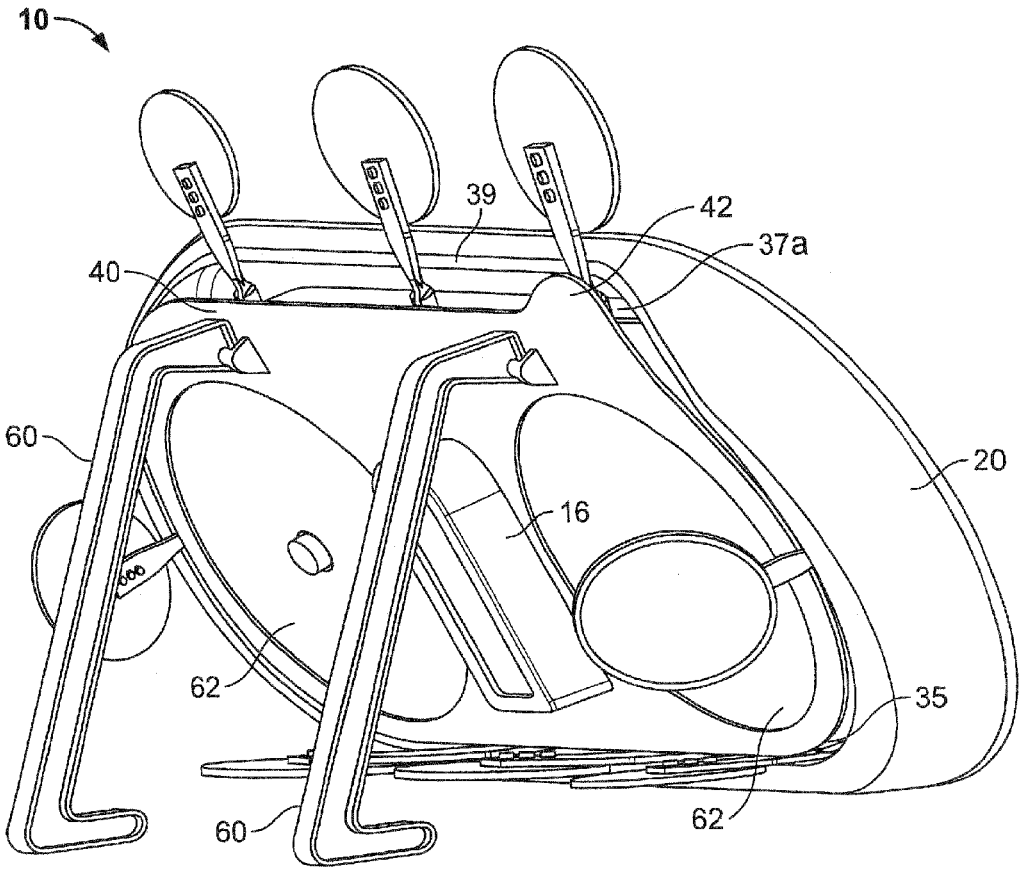
FIG. 3A is a rear right perspective view of the moving target apparatus.

Referring to FIG. 3A, the rear of apparatus 10 is shown. Rear panel 40 has a chamber 16 for housing a gear box and for housing a motor and an electric or battery power supply.

Front casing 20 may accommodate one or a plurality of outer target areas. FIGS. 1 and 2 show one embodiment of the invention wherein the front casing 20 is adapted to accommodate two outer target areas 50 and 52. Outer target areas 50 and 52 each comprise at least one aperture 55 or a plurality of apertures 55.

Apertures 55 may be of any desired shape, including but not limited, to circular, oval, rectangular or polygonal. Additionally, outer target areas 50 and 52 may have an equal or differing number of apertures. Further, apertures 55 of outer target area 50 may be of the same shape or different shape of apertures 55 on outer target area 52.

Figure 4:
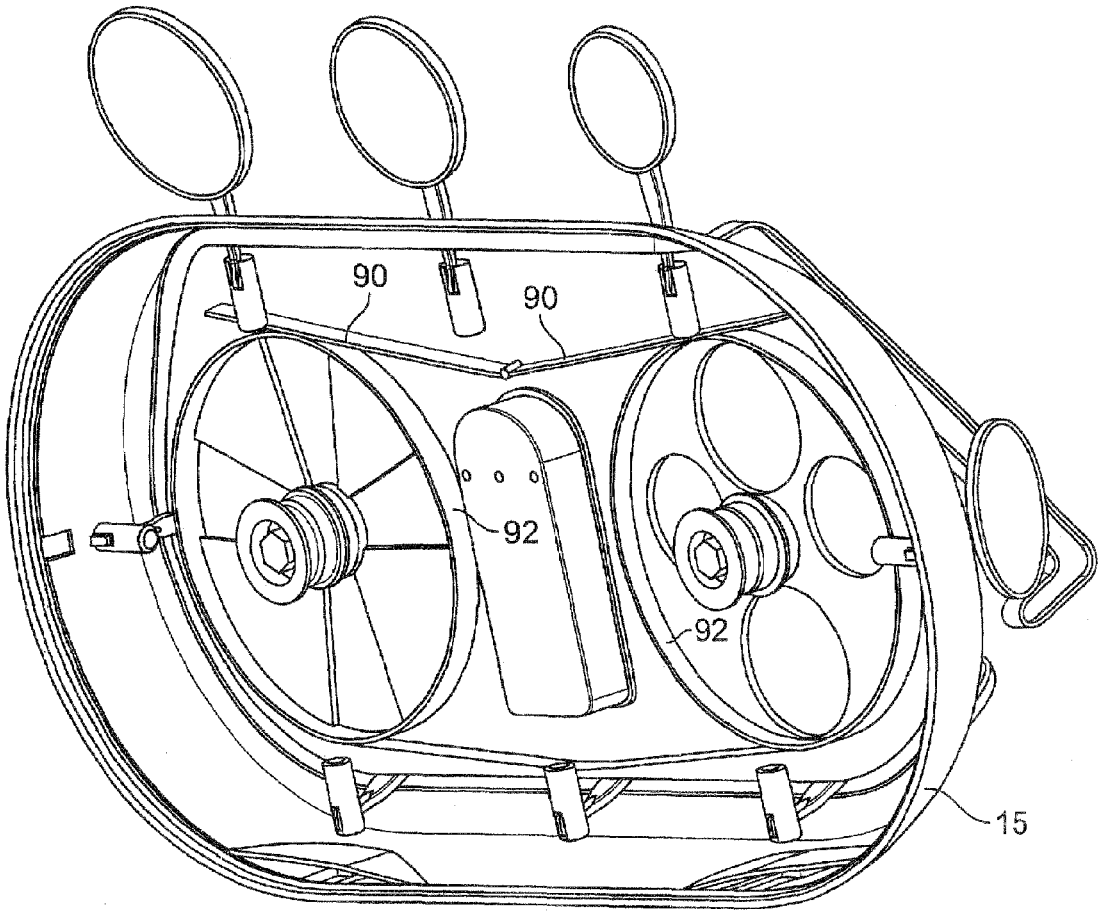
FIG. 4 is an interior front view of the moving target apparatus with a portion of the front casing removed.
Figure 5:
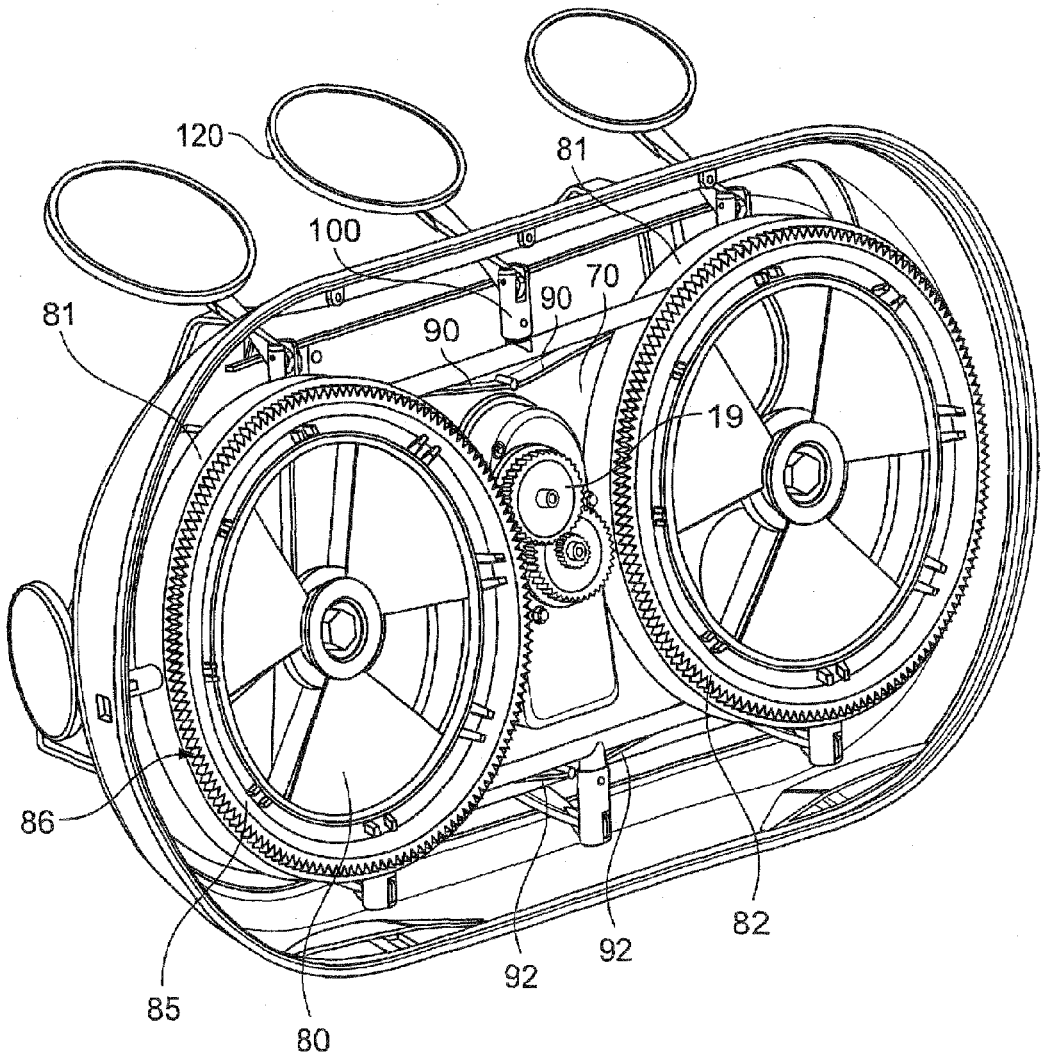
FIG. 5 is a partial left interior perspective view with a portion of the front casing removed.

Referring to FIGS. 4 and 5, the apparatus 10 is shown with a portion of the front casing 20 removed to expose the interior portion of apparatus 10. Gear box 15 comprises a driving gear 17 and driven gear 19. Any suitable gear arrangement may be utilized, as known in the art. Any number of gears or gear sizes may be utilized to allow the torque of the driving gear to produce either a larger or smaller torque in the driven gear 19, and therefore also impact the speed of rotation.

Inner target areas 80 and 82 are wheels that are directly disposed behind outer target areas 50 and 52, preferably behind front casing 20 and preferably mounted to rear panel 40. Inner target wheels 80 and 82 are rotated by the gear assembly, such that driven gear 19 meshes with the circumference 86 of wheel 80. Circumference 86 has teeth or is adapted to mesh with said gear 19 in the known manner. Alternatively, gear 19 could be adapted to mesh with a toothed circumference of wheel 82. Inner target areas 80 and 82 are secured to the rear panel by any manner permitting rotation about an axis perpendicular to the rear panel 40, as is known in the art, for instance a nut and bolt assembly or any other suitable mechanism. Alternatively, inner target areas 80 and 82 may be secured to the front casing 20 in the same manner.

Each of inner target areas 80 and 82 have an open groove 81 recessed into their respective circumference permitting belt 70 to be seated therein. When in operation, the power source will power a motor that will engage driving gear 17 that will rotate driven gear 19. Driven gear 19 engages toothed circumference 86 of inner target area 80, causing belt 70 to reciprocate and rotate inner target area 82. Alternatively, both inner target areas 80 and 82 may be driven by separate gears as is known in the art, without the use of a belt 70.

In a preferred embodiment, inner target areas 80 and 82, each contain at least one aperture 85. When said inner target areas 80 and 82 are rotated, said aperture 85 will align with said aperture 55 in outer target areas 50 and 52 to briefly create an opening 58 to receive a projectile fired by a user. It is not required that the number of apertures 55 equal the number of apertures 85. Further, the shape of apertures 55 and 85 need not be identical. In one embodiment, aperture 85 is smaller in dimension than aperture 55, thereby shortening the time interval during which an opening 58 is created during the rotation of wheel 80 or 82 and thereby increasing the challenge for a user to fire a projectile in time to reach the opening 58. In an alternate embodiment, aperture 85 is larger than aperture 55, thereby increasing the time interval that an opening 58 is created and thereby decreasing the challenge for a user to fire a projectile in time to reach the opening 58.

As seen in FIG. 3A, In a preferred embodiment, a coloured and/or textured material 62 is disposed behind the inner target wheels 80 and 82, preferably by being mounted to the inside of the rear panel 40. Said material may also comprise images for instance depicting animals or human shapes. In an alternate embodiment, said rear panel 40 may comprise cut-out portions corresponding to the shape and number of apertures in outer target areas 50 and 52. In this manner, said material 62 could be affixed to the back of rear panel 40. Therefore, when an opening 58 is created, the coloured or textured material 62, will be visible to the user from the front of the apparatus 10 and will thereby create a visual cue to a marksman to fire at the opening 58. Said material 62 may also be of a quality that will emit a sound when hit and thereby provide a hit judging means when hit by a marksman. Alternatively, there may be a sensor affixed to the rear side of wheels 80 and 82, wherein said sensor may be programmed to count the number of hits.

In a further embodiment, inner target wheels 80 and 82 are comprised of a material, for instance a metal such as tin or aluminum, that will emit a sound when hit to denote that the marksman/user was unsuccessful in that the projectile has not been received by the opening and instead has hit inner target areas 80 and 82.

In still another embodiment, the illusion of an opening 58 may be created for a user, such that the surface of wheels 80 and 82 may comprise segments of varying colour or visual appearance for instance, to resemble the appearance of material 62 disposed behind the inner target wheels 80 and 82, thereby increasing the challenge for a user in being able to discern between an actual opening 58 which reveals backing material 62 and the segments of varying colour or visual appearance on the inner target wheel which will become visible through aperture 55 at various intervals of rotation of inner target areas 80 or 82.

Apertures 55 may be cut out of the front casing 20 and are therefore permanently in the open state. In another embodiment, outer target areas 50 and 52 may be disposed on wheels that are rotatable while inner target areas 80 and 82 are stationary.

In still a further embodiment, apertures 55 may themselves be opened and closed by a flap connected to the front casing 20 at timed intervals. When aperture 55 is opened, it may or may not align with aperture 85 on inner target wheel 80 thereby add to the unpredictability of the target practice for a marksman. The opening and closing of said apertures 55 may be controlled by a timer activated device as is known in the art. The speed of the opening and closing of said aperture may also be variable.

In a further embodiment, aperture 55 may be closed by way of a spring loaded closure that is timed to open and close at a specific coordinate on the moving target area. Said closure may be fan-like and span the entire 360° of the outer target areas 50 and 52, and open for a limited time at a specific coordinate. The width of the opening may also be controlled. When aperture 55 is opened, it may or may not align with aperture 85 during the rotation of inner target areas 80 or 82, thereby adding to the variability that an opening will be created.

Referring now to FIG. 5, the mechanism which deals with the toppling targets 120 is described. Belt 70 is preferably made of a rubber material, or any other suitable polymer or elastomer material. In a preferred embodiment, belt 70 is tubular; the tubular shape providing strength and durability. Toppling targets 120 are mounted to belt 70 which will rotate said toppling targets 120 around apparatus 10. Said belt 70 may follow the path of rotation created by its connection to inner target wheels 80 and 82.

In an alternate embodiment, the contour of apparatus 10 has curvilinear side portions, and toppling targets 120 are made to travel along a horizontal and vertical path when in the upright position, rather than the linear path shown in FIG. 5. In this embodiment, the path of toppling targets 120 is altered by a series of peg like projections disposed in the apparatus 10, in either the front casing 20 or rear panel 40, such that belt 70 must pass over such projections. In this manner, targets 120 will follow a non-linear path along both a horizontal and vertical plane.

Figure 3B:
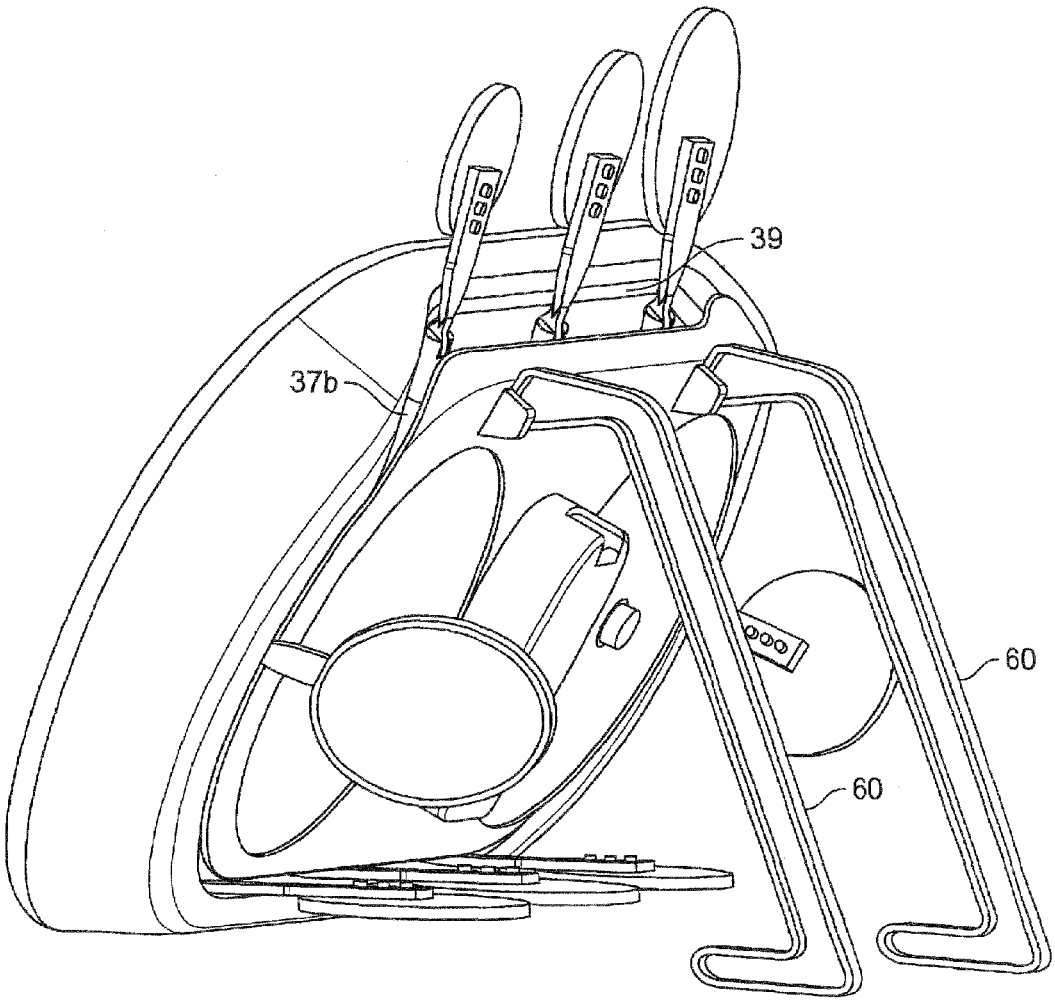
FIG. 3B being a rear left perspective view thereof.

Referring now to FIGS. 3A and 3B, the manner in which toppling targets are toppled and reset is shown. Rear panel 40 forms an exposed channel 35 with casing 20, channel 35 being disposed between the circumference of the rear panel 40 and the front casing 20, channel 35 having a first width. Channel 35 widens at the top of apparatus 10 into channel 39 having a second width. Rear panel 40 and front casing 20 are shaped to form generally V-shaped or U-shaped slots 37*a* and 37*b*, therebetween. Slots 37*a* and 37*b* will act as expansion and constriction points along channels 35 and 39. Slots 37*a* and 37*b* are each disposed adjacent to channel 39. Channel 35 widens at the first V-shaped slot 37*a* into channel 39. Channel 39 narrows into channel 35 after the second V-shaped slot 37*b*. In an alternative embodiment, channel 39 may be disposed on the side of the apparatus 10 rather than top of the apparatus 10. In a preferred embodiment, channel 39 is disposed at the top of apparatus 10 and one top corner of rear panel 40 is raised slightly as tip 42. Tip 42 is disposed on the side corresponding with the toppling targets 120 returning to the upright position. Tip 42 will assist in providing support to the stem of toppling target 120 as it is guided into the upright position by slot 37*a* as will be described below. As described above, sides of the apparatus 10 may be curvilinear. As such, channel 39 may be curvilinear to further increase the challenge to a user thereby creating up and down movement as the toppling target 120 travels in the upright position.

Referring to FIG. 5, belt 70 comprises at least one support member 100, and preferably a series of support members 100 that may be spaced at equal intervals from one another or irregularly spaced from one another. Support members 100 are adapted to hold the toppling targets 120 in place as they travel along the path defined by the belt 70 in channel 35 and channel 39, and slots 37*a* and 37*b*.

Figure 6A:
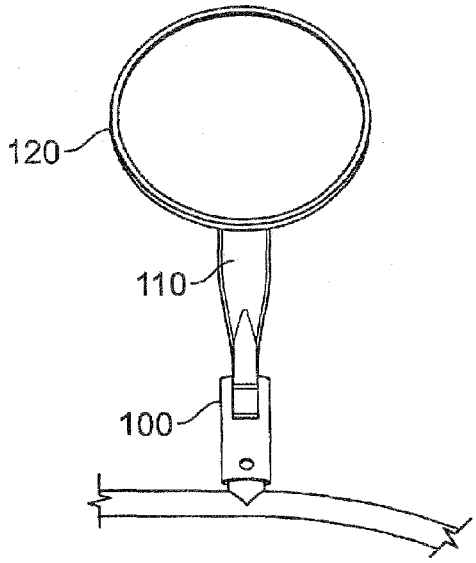
FIGS. 6A and 6B are exploded views showing the connection of the toppling target to the apparatus.
Figure 6B:
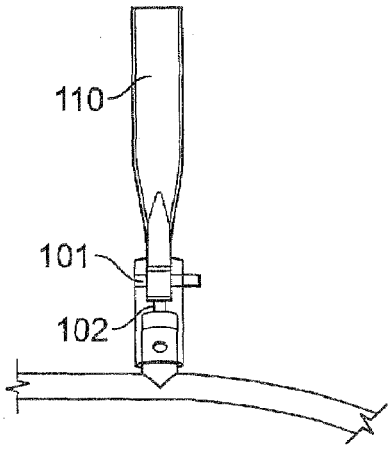
Figure 6C:
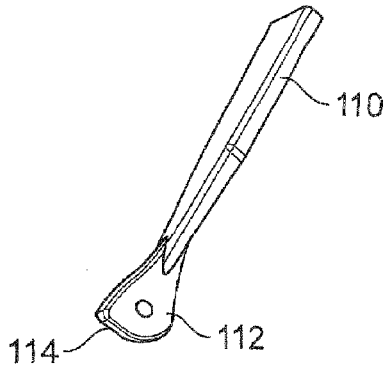
FIG. 6C shows the stem of the toppling target in isolation illustrating the end of said stem according to a preferred embodiment.

Referring to FIGS. 6A and 6B, the manner of connection of the toppling targets to the belt 70 is shown. Toppling targets 120 each have an impact area which may be round or in the shape of an animal or human figure, or scored in the usual manner. The impact area of toppling targets 120 may be comprised of any material, for instance metal, that will emit a "ping" sound when hit. Each toppling target 120 has a stem 110 which is attached to a support member 100 via a horizontal pin 101 which permits rotational movement about the axis of the pin 101. In order to prevent toppling targets 120 from dropping under gravity, in a preferred embodiment, the support member 100 contains a projection 102 which rests against the end 112 of stem 110. Referring to FIG. 6C, end 112 has a groove 114 which engages projection 102 to maintain the toppling target in an upright position when said targets 120 are at the top of the apparatus traveling through channel 39. The resistance in knocking down the toppling target can be increased or decreased, by adjusting the depth of the groove 114 and/or increasing the length of the projection 102. If the depth of the groove 114 is increased for instance, this will increase the resistance of target 120 to being toppled by a projectile.

Alternatively, end 112 may comprise a projection that engages with a groove disposed in support member 100, thereby providing resistance to toppling under gravity.

In a further embodiment, stem 112 may be maintained in the upright position by way of a spring disposed in support member 100.

In still a further embodiment, end 112 and support member 100 may be at right angles to one another connected via a pin 101, the right angles providing a resistance to maintain the target 120 in the upright position.

During the rotational movement of the belt 70, toppling targets 120 are in an upright position when in channel 39. When toppling target 120 is impacted by a projectile, it will moved from an upright position to a down position. If the toppling target 120 is not hit by a projectile once it has traveled to the end of channel 39, stem 110 will be pushed down by the constriction formed by V-shaped slot 37*b*. Target 120 will be impeded from traveling along channel 35 in an upright position due to v-shaped slot 37*b*. Stem 110 will continue to travel along channel 35 until it reaches the opposite V-shaped slot 37*b*. At slot 37*b*, target 120 will resume its upright position and in a preferred embodiment, stem 110 is further guided into the upright position by raised tip 42 on rear panel 40.

In another embodiment, a spring supported by the support member 100 rests against lower end of stem 112 and the toppling targets are held in an upright position when the spring rests against 112. The targets are held in the down position when the spring rests against the rear surface of the stem 112 as the targets 120 travel through channel 35.

Referring to FIG. 1 and FIG. 4, in an optional embodiment, apparatus 10 is equipped with a mechanism that will assist in the collection of the pellets after they are fired at the targets and at the openings.

Some pellets which hit the toppling targets may fall through channel 39 and onto pellet tracks 90 that are inclined downwardly at an angle sufficient that a pellet will move by gravity to be collected in reservoir 15 at the base of apparatus 10. Pellet tracks 90 may be mounted to rear panel 40 or disposed directly above wheels 80 and 82. Similarly, pellet tracks 92 are disposed in rear panel 40 and form an open ring around wheels 80 and 82, with the open portion terminating in a downwardly inclined position such that projectiles that are received through an opening 58 will, by gravity, be lead to pellet track 92 and be guided down to reservoir 15, disposed in front casing 20.

The invention claimed is:

1. A moving target practice apparatus comprising:

a front casing mounted to a rear panel, wherein said front casing supports at least one outer target means;

said at least one outer target means comprising at least one first aperture;

at least one inner target means disposed behind said at least one outer target means between said front casing and rear panel;

said inner target means comprising at least one second aperture, means for rotating at least one of said inner target means and said outer target means, such that said at least one first aperture and said at least one second aperture will align to create an opening to receive a projectile, wherein said front casing and said rear panel form a generally enclosed target area, and wherein said rear panel defines an exposed channel with said front casing;

said channel extending between said front casing and the circumference of the rear panel;

said channel having a narrow portion and a wide portion, said wide portion disposed along said channel between a first and a second point along said channel;

at least one toppling target supported in said channel wherein said target will topple when hit, said channel defining a path for the target;

means for moving said at least one toppling target around the channel;

said at least one toppling target being in an upright position when in said wide portion; said at least one toppling target is pushed in a down position if not hit by a projectile, when said at least one toppling target travels through said first point into said narrow portion; and wherein said at least one toppling target is forced in an upright position when it travels through said second point returning to said wide portion.

2. The moving target apparatus of claim 1 wherein said rear panel comprises a raised tip in a corner adjacent to the second point, thereby supporting said at least one toppling target when returned to the upright position.

3. The moving target apparatus of claim 1 wherein said first and second point comprise a V-shaped slot formed between said rear panel and front casing.

4. The moving target apparatus of claim 1 wherein said means for moving said at least one toppling target comprises a belt disposed around said inner target means and rotated by said inner target means, said belt comprising at least one support member to movably hold said at least one toppling target, wherein said toppling target is movable about a rotational axis disposed in said support member.

5. The moving target practice apparatus of claim 4 wherein said wide portion of said channel is curvilinear.

6. A moving target apparatus for shooting practice comprising:

a front casing mounted to a rear panel, to form an enclosed target area;

wherein said rear panel defines an exposed channel with said front casing;

said channel extending between said casing and the circumference of the rear panel;

said channel having a narrow portion and a widened portion, said widened portion disposed along said channel between a first and second point along said channels;

at least one toppling target supported in said channel wherein said target will topple when hit, said channel defining a path for the target;

means for moving said at least one toppling target around the channel;

said at least one toppling target being in an upright position when in said widened portion; said at least one toppling target is pushed in a down position if not hit, when said at least one toppling target travels through said first point into said narrow portion; and wherein said at least one toppling target is forced in an upright position when it travels through said second point returning to said widened portion.

7. The moving target apparatus of claim 6 wherein said rear panel comprises a raised tip in a corner adjacent to the second point, thereby supporting said at least one toppling target when returned to the upright position.

8. The moving target apparatus of claim 6 wherein said first and second point comprise a V-shaped slot formed between said rear panel and front casing.

9. The moving target apparatus of claim 6 wherein said means for moving said at least one toppling target comprises a belt disposed around said inner target means and rotated by said inner target means, said belt comprising at least one support member to movably hold said at least one toppling target, wherein said toppling target is movable about a rotational axis disposed in said support member.

10. The moving target practice apparatus of claim 6 wherein said wide portion of said channel is curvilinear.

* * * * *